United States Patent [19]

Bononi et al.

[11] Patent Number: 4,594,874

[45] Date of Patent: Jun. 17, 1986

[54] METHOD OF FORMING SOCKET WRENCHES FROM TUBING

[75] Inventors: Fred A. Bononi, Simsbury; Armand J. Weis, deceased, late of North Granby, both of Conn., by Delma G. Weis, legal representative

[73] Assignee: Veeder Industries Inc., Hartford, Conn.

[21] Appl. No.: 512,677

[22] Filed: Jul. 11, 1983

[51] Int. Cl.[4] ..... B21D 22/00

[52] U.S. Cl. ..... 72/356; 72/354; 72/377

[58] Field of Search ..... 72/356, 367, 370, 358, 72/359, 377, 354; 76/101 R

[56] References Cited

U.S. PATENT DOCUMENTS

| | | | |
|---|---|---|---|
| 381,355 | 4/1888 | Firth et al. . | |
| 934,174 | 9/1909 | Hooker . | |
| 1,964,258 | 6/1934 | Graham | 29/153.1 |
| 1,982,874 | 12/1934 | Jamison | 29/156 |
| 2,165,472 | 7/1939 | Friedman | 72/377 |
| 2,965,965 | 12/1960 | Allan | 72/356 |
| 3,292,414 | 12/1966 | Goeke | 72/402 |
| 3,735,463 | 5/1972 | Merola | 29/155 C |
| 3,977,227 | 9/1976 | Noble | 72/367 |
| 4,061,013 | 12/1977 | Kuc et al. | 72/354 |
| 4,122,701 | 10/1978 | Lehnhart | 72/354 |
| 4,166,373 | 9/1979 | Braun | 72/356 |
| 4,291,568 | 9/1981 | Stifano, Jr. | 72/377 |
| 4,292,831 | 10/1981 | Simon | 72/370 |
| 4,352,283 | 10/1982 | Bailey | 72/354 |

FOREIGN PATENT DOCUMENTS

| | | | |
|---|---|---|---|
| 28261 | 3/1979 | Japan | 72/367 |

OTHER PUBLICATIONS

Extracts from *Source Book on Cold Forming*, published by American Society for Metals, 1975.

Extracts from *Helping You Flow Metal*, published by The National Machinery Co., 1976.

*Primary Examiner*—Francis S. Husar

*Assistant Examiner*—David B. Jones

*Attorney, Agent, or Firm*—Hayes & Reinsmith

[57] ABSTRACT

The disclosed method features an automatic high production process of forming a socket wrench and other elongated hollow parts such as a nutdriver from a tubular metal workpiece. The method of making a nutdriver includes extruding a workpiece through a tapered female die to reduce both the inside and outside diameters at one end of the workpiece and along a predetermined portion of its length from that one end of the workpiece. A recess of non-circular cross section is formed at the other end of the workpiece. In the method of making a socket wrench, an additional step is included in forming another recess of non-circular cross section at the reduced end of the workpiece.

16 Claims, 20 Drawing Figures

METHOD OF FORMING SOCKET WRENCHES FROM TUBING

FIELD OF THE INVENTION

This invention generally relates to work forming processes and particularly concerns an improved method of forming socket wrenches and other elongated hollow parts such as nutdrivers.

BACKGROUND OF THE INVENTION

Various processes have been used in the past in forming socket wrenches. A successful technique is disclosed in U.S. Pat. No. 4,291,568 assigned to the assignee of this invention.

The socket wrench itself is a standard device, well known in the art, having a conventional square drive socket at one end, releasably attachable to a drive tang of a handle unit, and a fastener socket is coaxially formed at an opposite end of the wrench. The fastener socket is normally of hexagonal cross section. A through-hole extends between the coaxially aligned sockets and serves to provide clearance, e.g., for a shank of a bolt on which a hex nut is threadably engaged with the nut received within the hex fastener socket. For a quality product, such socket wrenches are normally formed of alloy steel.

Standard screw machines have been commonly utilized in the manufacture of such wrenches, as well as both hot and cold forging processes. The known methods of making such devices such as in U.S. Pat. No. 4,291,568 and other patent teachings exhibited by U.S. Pat. Nos. 4,166,373 and 4,061,013 each form the tool part from a solid cylindrical workpiece blank or slug. In this respect, it is common practice to normally begin a process with a solid workblank having a body size which generally corresponds to the outside diameter of the shank of the tool part which is of reduced size relative to a recessed end of the tool. U.S. Pat. No. 4,352,283 shows a method of cold forming spark plug bodies from a solid cylindrical blank. The state of the art also includes a variety of methods of working hollow pipe and tubing such as shown in U.S. Pats. Nos. 3,977,227, 3,735,463, 3,292,414, 1,982,874, 1,964,258, 934,174 and 381,355.

While the state of the art provides teachings of both hot and cold working of tubing, nonetheless, the known processes for making socket wrenches (and similar devices incorporating elongated hollow parts such as nutdrivers) have all utilized a solid metal billet from which the desired hollow elongated part is ultimately formed, presumably because of heretofore unsolved difficulties in forming such tool parts from original workpieces other than solid metal billets.

OBJECTS OF THE INVENTION

A primary object of this invention is to provide a new and improved method of forming socket wrenches and other elongated hollow parts such as nutdrivers utilizing an uninterrupted multiple step operation which features the working of a single tubular workpiece to provide a low cost end product of high quality.

Another object of this invention is to provide such a process of making socket wrenches and the like wherein costly and time-consuming machining operations, such as drilling a through-hole for deep socket wrenches customarily encountered in the prior art, are essentially eliminated.

A further object of this invention is to provide a method of the type described which is particularly suited to provide repetitive uniform quality of a finished product over extended periods of machine operation under demanding conditions utilizing alloy steel materials, which normally are not easily cold worked in an initial tubular form, for the production of socket wrenches and nutdrivers in a variety of sizes.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of this invention are employed.

SUMMARY OF THE INVENTION

The method of this invention includes a series of steps wherein a tubular workpiece is provided together with die cavity means and a driving step is effected to drive the workpiece into the die cavity means with a power operated punch for reducing both the inside and outside diameters at one end of the workpiece and along a predetermined length of the workpiece from said one end to form a longitudinally extending shaft of reduced diametrical dimensions relative to the original diametrical dimensions of the workpiece. A recess forming step is also effected to form a recess of non-circular cross section at the other end of the workpiece opposite its said one end by driving a second power operated punch of non-circular cross section into said other end of the workpiece.

DESCRIPTION OF THE PREFERRED EMBODIMENTS

Figure 1:
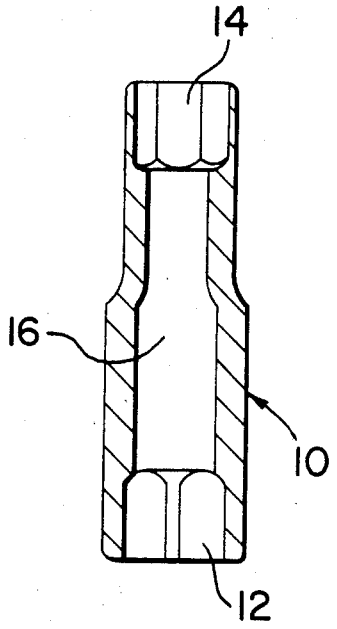
FIG. 1 is a cross-sectional view showing a typical socket wrench.

In FIG. 1, a socket wrench 10 is illustrated having a square drive socket 12 at one end which is of enlarged cross section relative to a fastener driving hex socket 14 at the opposite necked-down end of the body with a clearance through-hole 16 therein. It is to be understood that a handle unit, not shown, is attached in a well known manner to square drive socket 12 for rotating socket wrench 10 in a desired direction for tightening or releasing a fastener, not shown, engaged by fastener driving hex socket 14.

Figure 2:
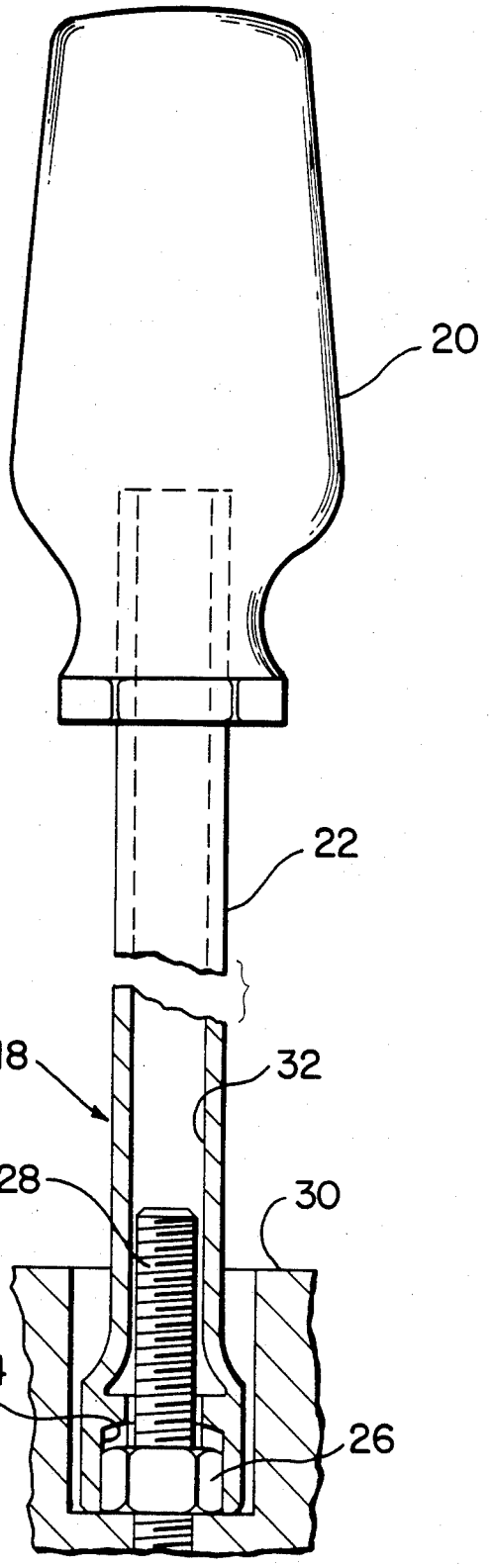
FIG. 2 is a view, partly in section and partly broken away, showing a nutdriver in operative relation to a nut to be run down on a bolt fixed to a base member.

A similar type device is illustrated in FIG. 2 wherein a nutdriver 18 is illustrated having a suitable handle 20 drivingly connected to a longitudinally extending shaft 22 of nutdriver 18. A fastener driving hex socket 24 of enlarged cross-sectional dimensions is provided on an end of shaft 22 opposite its handle 20 for engaging a fastener such as the illustrated hex nut 26 mounted on bolt 28 threadably secured to a base member 30. As illustrated, nutdriver 18 has an axially extending through-opening 32 to provide clearance for the shank of bolt 28 on which nut 26 is received within fastener driving hex socket 24 to permit that nut to be rotated by nutdriver 18.

As is well known to those skilled in the art, high quality hand tools of the type described have long been made from alloy steels while cheaper versions are made of carbon steels. This invention is particularly suited for making the more desirable high quality hand tools of alloy steels.

Figure 3:
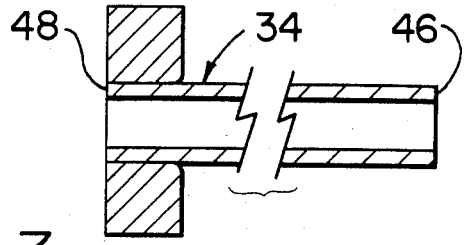
FIGS. 3–5 are schematic representations showing one embodiment of a method of this invention.
Figure 4:
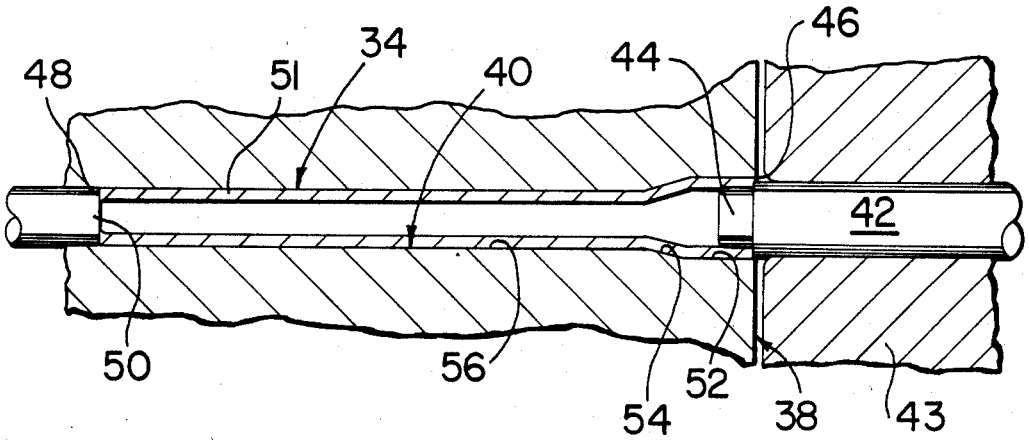
Figure 5:
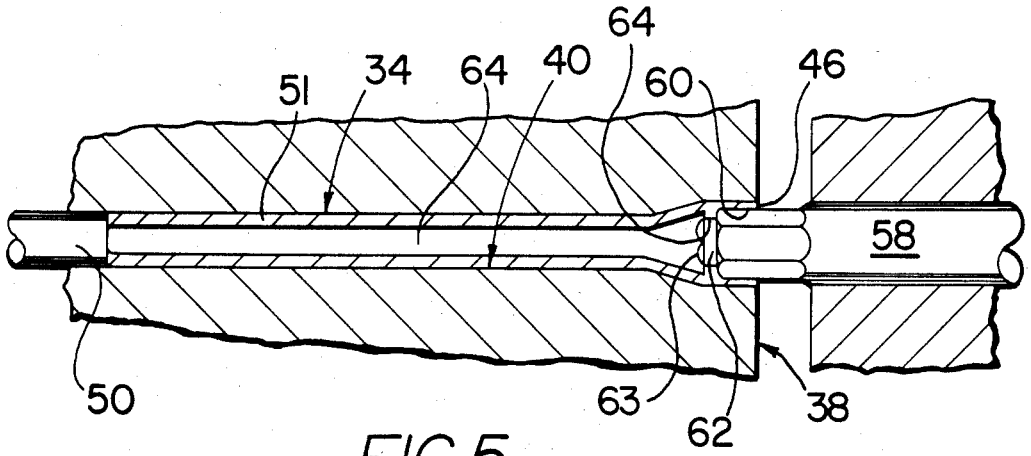
Figure 6:
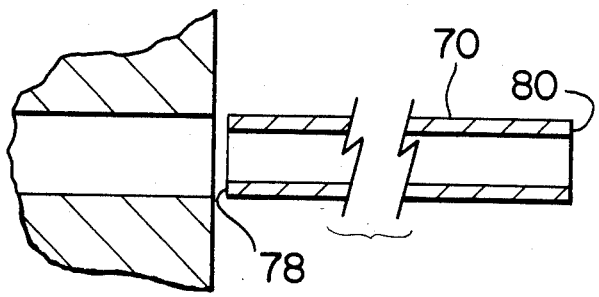
FIGS. 6–9 are schematic representations of method steps of a second embodiment of this invention.

To eliminate the conventional secondary operations now commonly employed in the production of socket wrenches, nutdrivers and the like, a significantly simplified manufacturing operation is provided by utilizing a heading process with ductile tubular stock in accordance with this invention. FIGS. 3–5 show an operational process of this invention for making a nutdriver in a single die, double stroke cold heading process utilizing welded or seamless tubing.

Metal tubing stock will be understood to be supplied in specially sized dimensions of uniform initial outside diameter and uniform initial wall thickness. For this purpose, readily available standard alloy steel seamless or welded tubing, such as AISI 4130 in an annealed condition, has been successfully used. That tubing stock is initially precut to length to form a tubular workpiece illustrated at 34 for transfer into a longitudinally aligned position with a first die station 38 having a female die cavity 40 of a predetermined volume. A ram, not shown, moves round driving punch 42 (within guide member 43) having a pilot 44 dimensioned to be inserted into a trailing end 46 of workpiece 34 and forces a leading end 48 of that workpiece into cavity 40 to an extent limited by a knock-out stop pin 50. Such action serves to apply an axial extrusion pressure causing the ductile tubular stock to reach its compression yield point and traverse the die 40 in a state of plastic flow. The workpiece 34 is elongates and both its inside and outside diameters are reduced at end 48 and along a predetermined length of a portion of workpiece 34 while generally maintaining its wall thickness to form a longitudinally extending shaft 51 of reduced diametrical dimensions relative to the original diametrical workpiece dimensions. During this step, the ends 46 and 48 of workpiece 34 are squared in parallel planes normal with a major longitudinal workpiece axis.

In the specifically illustrated die cavity 40, a cylindrical entrance section 52 is of slightly greater diameter than the initial outside diameter of workpiece 34. Entrance section 52 is connected by a tapering frustoconical die section 54 to a coaxially aligned elongated cylindrical chamber section 56 of cross-sectional diameter less than that of the entrance section 52. Accordingly, pilot 44 of punch 42 generally maintains the initial dimensions of the material at end 46 of workpiece 34 such that upon retraction of the ram and its punch 42, a second broaching punch 58 (FIG. 5) of non-circular cross section, specifically hexagonal cross section, is forced into end 46 of workpiece 34 which is shown retained in die cavity 40 to broach a fastener driving hex socket 60 causing a natural flow of material about a round pilot 62 on a leading end of hexagonal punch 58 and causing scallops 63 to be formed along the inside wall of the workpiece 34 ahead of pilot 62. Pilot 62 will be understood to be of a diameter about equal to that of the inside diameter of the extruded shaft 51 of workpiece 34 whereupon its inside diameter is maintained by pilot 62 and a coaxially extending through-opening 64 is formed within the workpiece. Upon retraction of the ram and its hexagonal punch 58, the knock-out stop pin 50 moves to eject workpiece 34 so formed from die 40 in the above described single die, double stroke operational process. Thus, a nutdriver is provided with a fastener driving hex socket 60 at one end, its opposite end being attachable to a handle such as at 20 in FIG. 2.

Referring now to FIGS. 6–9, a two die, three blow cold heading process is depicted wherein a precut length of tubing, serving as an original workpiece 70 in accordance with this invention, is suitably transferred into longitudinal alignment with a first die 72. As in the first embodiment, a ram, not shown, drives a round punch 74 which forces that tubular workpiece 70 into an elongated die cavity 75 against a knock-out stop pin 76 to square opposite workpiece ends and to reduce the inside and outside diameters at the leading end 78 of workpiece 70 and along a predetermined length of that workpiece from its leading end 78 to form a longitudinally extending shaft of reduced diametrical dimensions. Material of workpiece 70 at its trailing end 80 is simultaneously gathered about a leading round pilot 82 of punch 74 within an entrance section 84 of die cavity 75. The pilot 82 is of a predetermined reduced diameter relative to the inside diameter of workpiece 70, and entrance section 84 is of enlarged diametrical dimension relative to the workpiece outside diameter and to elongated chamber section 86 to which entrance section 84 is connected by a tapered frustoconical section 88.

Upon retraction of the ram and punch 74, the knock-out stop pin 76 drives workpiece 70, as extruded in die cavity 75 out of that cavity for transfer by suitable transfer fingers, not shown, into longitudinal alignment with a downstream second die 90 having a generally similar cross-sectional configuration to that of die cavity 75 of the upstream die 72. Workpiece 70 is accordingly aligned with the second die 90 whereupon a power operated punch 92, associated with the ram, is driven toward that die 90 such that its leading pilot 94 enters the central opening at end 80 of workpiece 70 which in turn is driven into cavity 96 of the second die 90 against knock-out stop pin 98 whereupon opposite ends 78, 80 of workpiece 70 are formed. To aid in centering a broaching punch 100 in the next step (FIG. 9), the juncture between punch 92 and its pilot 94 may be configured to counter-sink trailing end 80; the leading end 78 of the workpiece is squared relative to a major longitudinally extending workpiece axis.

Subsequent to withdrawal of the ram and punch 92, a ram operated hexgonal broaching punch 100 having a leading pilot 102 of relatively reduced diameter forces the metal (as gathered in die 96, FIG. 8) between the interior wall of entrance section 104 of die cavity 96 and the external surface of the hexagonal punch 100 and its pilot 102, thereby to effect a broaching action within entrance section 104 of die cavity 96 to form a hexagonal fastener driving socket 106 while preserving a central through-opening 108 along the full length of workpiece 70. Thereafter, knock-out stop pin 98 is actuated to drive the nutdriver so formed out of cavity 96 of the second die 90.

Another embodiment of this invention is illustrated in FIGS. 10–13. Depending on the nominal size nutdriver desired, a specially sized tubular workpiece 110 is suitably transferred into longitudinal alignment with a first die station 112 and is cold extruded as described in the previous embodiments in cavity 114 to form a longitudinally extending shaft 116 of reduced diametrical dimensions relative to those of the original workpiece dimensions. Pilot 118 of punch 120 cooperates with entrance section 122 to dimensionally maintain trailing end 124 of workpiece 110. The extruded shaft 116 is then driven out of cavity 114 by pin 126 and transferred by transfer fingers, not shown, to a second die station 128 (FIG. 11) and driven into its die cavity 129 by a ram operated punch 130 which has a leading pilot 132 of reduced diameter relative to that of pilot 118 of punch 120 (FIG. 10) thereby to effect a natural cold flow of material to gather about pilot 132. Thereafter, transfer fingers, not shown, move workpiece 110, upon its being driven from die station 128 by knock-out stop pin 134, into longitudinal alignment with a third die station 136.

Figure 13:
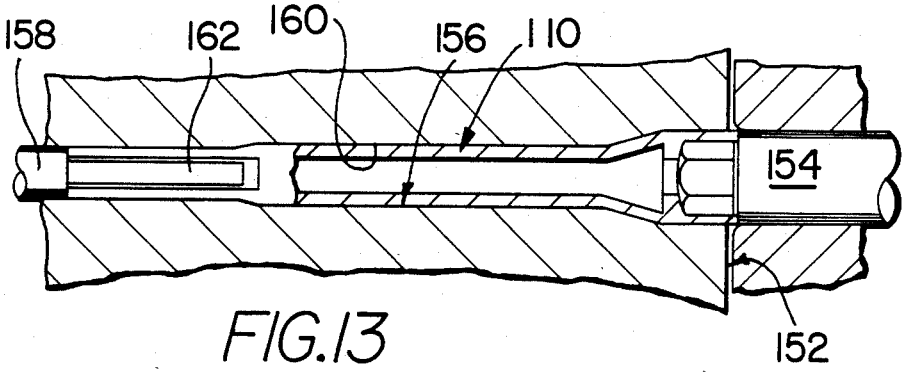
Figure 14:
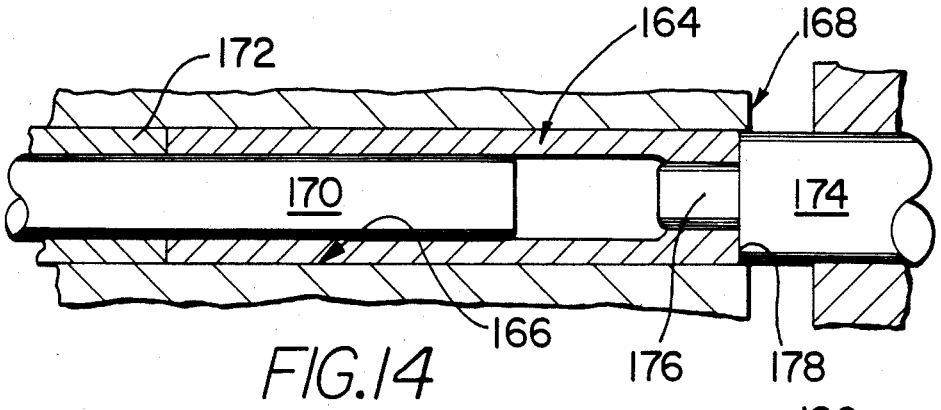
FIGS. 14–17 are schematic representations of method steps of a fourth emodiment of this invention.
Figure 15:
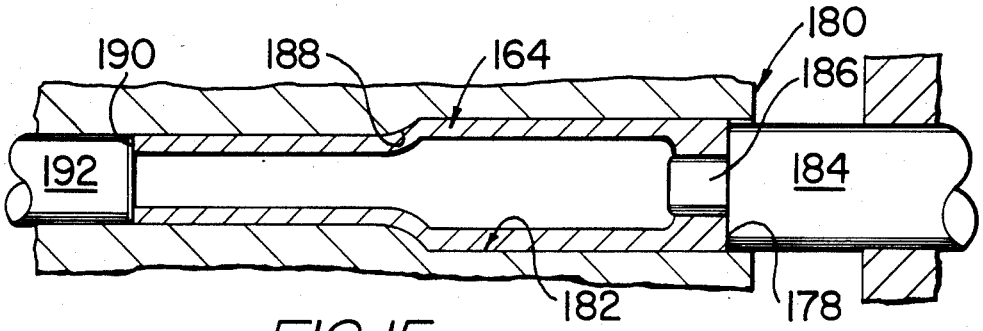

At this station 136 (FIG. 12), trailing end 124 of workpiece 110 is broached in response to a ram operated hexagonal punch 138 driving into end 124 of workpiece 110 to seat its leading end 140 against a knock-out stop pin 142, and the built-up material of workpiece 110 surrounding punch 138 and its pilot 144 is broached to form a fastener driving hex socket 146 in trailing end 124, whereby chips or scallops 148 may be formed ahead of pilot 144 which additionally functions to maintain the through opening. Workpiece 110 is then driven out of die cavity 150 by knock-out stop pin 142 upon retraction of punch 138 for transfer by die fingers, not shown, into longitudinal alignment with a downstream fourth die station 152 (FIG. 13).

To square ends 124, 140 of workpiece 110 in parallel planes normal to its major longitudinal axis, a punch 154 having a hexagonal cross section conforming to the fastener driving hex socket 146 is ram operated to drive workpiece 110 into die cavity 156 of die station 152 to an extent limited by a knock-out stop pin 158.

To provide handle gripping drive surfaces, it may be desired to form one or more splines and spline keyways on the external surface of reduced shaft 116 of the workpiece 110 simultaneously with its being driven into die cavity 156 of die station 152 by the ram operated punch 154. Internal wall of elongated chamber section 160 of die cavity 156 is configured to provide a radial protrusion 162 longitudinally extending from an inner end of elongated chamber section 160 along a preselected length of that chamber section toward the opposite entrance end of the die cavity 156 to form a radially projecting spline. It will be seen that the nutdriver formed with such a spline will provide radial sidewalls serving as drive surfaces. Upon being inserted into a handle such as at 20 in FIG. 2, these drive surfaces will cooperate with the handle material for transmitting a rotary motion to the nutdriver during its use.

It will be understood that because of the normal limitations of the inside diameter and wall thickness of the tubing, a gathering operation has been found to be particularly suitable in providing a sufficient amount of material to be broached and to ensure that the material of the workpiece itself will compress down about the leading pilot of the punch on the gate side of the header. The relatively long angle on the active die surface of the tapering frustoconical section in the die cavity between its entrance and elongated chamber sections provides a large pocket for folding the scalloped material formed by the broaching operation back about the pilot of the punch during that broaching action. In addition, by virtue of the described gathering operation, a uniform wall thickness of tubing may be efficiently utilized with a minimum amount of wall material. The tubing workpieces formed of alloy steels provide an enhanced column strength to effectively alleviate any tendency of the tube to collapse during an extruding operation. As described, the tubing is preferably a seamless tube or a welded tube which will cold flow uniformly during an extrusion step. In addition, it is anticipated that no secondary machining operations will be necessary except to possibly chamfer the head end and a desirable tumble polish after heat treatment and before plating.

Figure 7:
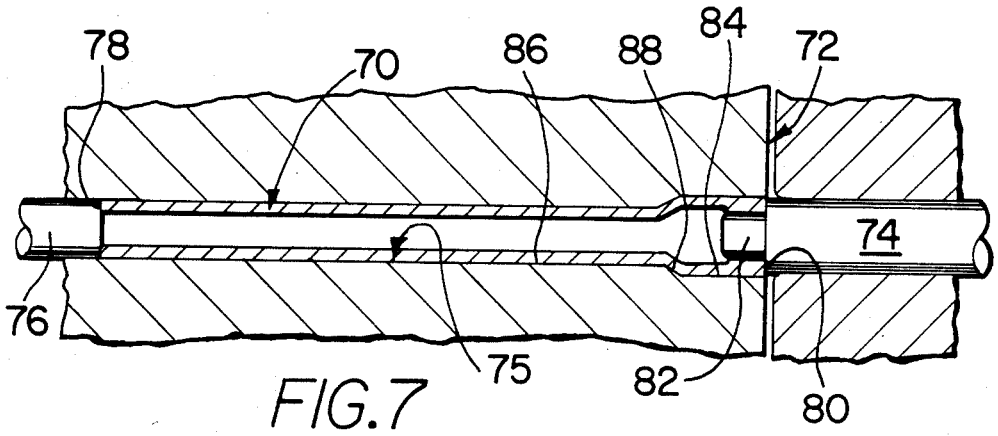
Figure 8:
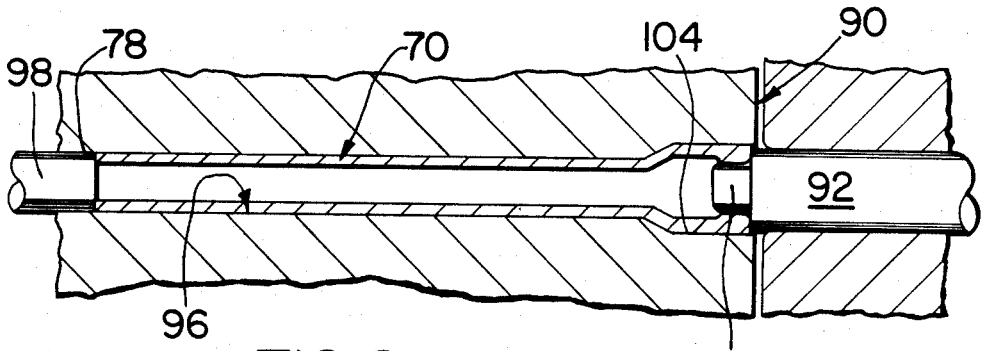
Figure 9:
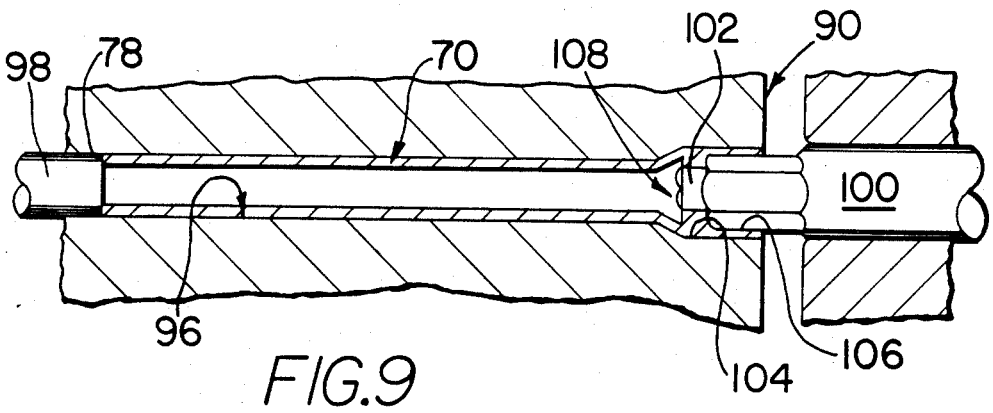
Figure 10A:
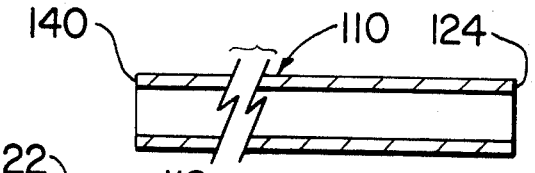
FIGS. 10–13 are schematic representations of method steps of a third embodiment of this invention.
Figure 10:
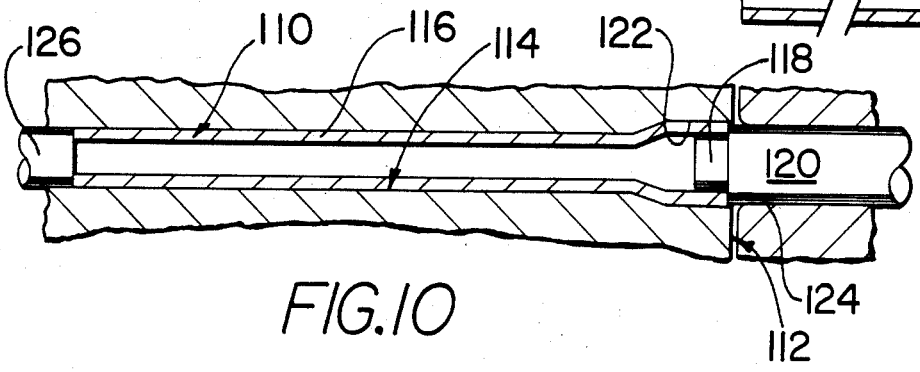
Figure 11:
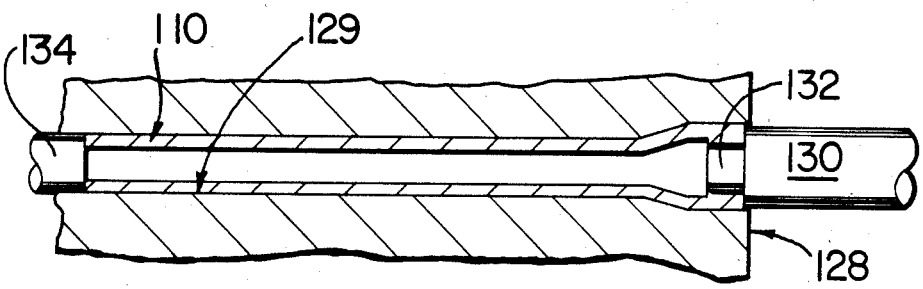
Figure 12:
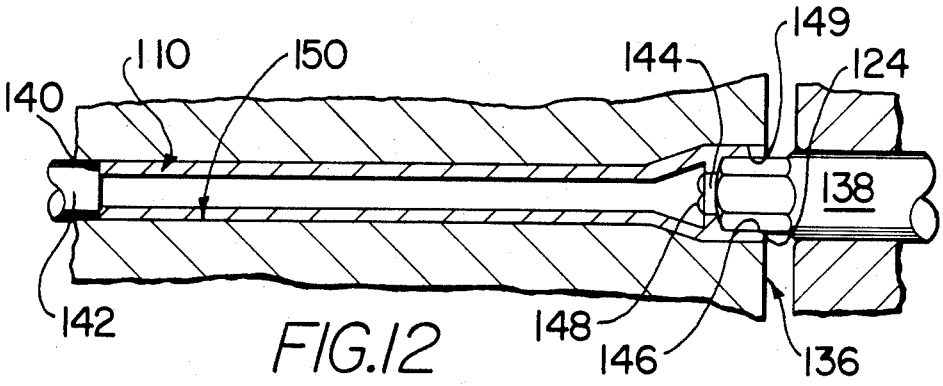

It is to be understood that the reduced shaft of the nutdriver formed in the described embodiment of FIGS. 7–9 can be splined (FIG. 9) as described in FIG. 13 or can be winged or swaged, as desired and then pressed into a plastic handle, e.g., thereby to transmit torque from the handle to the nutdriver shaft and its driven fastener.

Turning now to the embodiment of this invention in FIGS. 14–19, a method of forming socket wrenches is illustrated wherein it will be understood that a specially sized length of tubing serving as a workpiece 164 is driven into a die cavity 166 of a first die station 168 which cavity 166 is of uniform diameter slightly greater than workpiece 164 and is provided with a fixed sizing pin 170 and a movable kick-out sleeve 172. The outside diameter of workpiece 164 is maintained as ram operated punch 174 drives workpiece 164 into die cavity 166 and compresses the workpiece material about punch pilot 176 to gather that material and shape the body size at trailing end 178 of workpiece 164.

Thereafter, upon retraction of punch 174, the kick-out sleeve 172 drives workpiece 164 from cavity 166 for transfer of that workpiece to a downstream die station 180 (FIG. 15) where workpiece 164 is driven into a die cavity 182 by a ram operated punch 184 having a pilot 186 to retain the reduced inside diameter of trailing end 178. As in the previously described embodiments, die cavity 182 serves as a tapered female die having an active die surface 188 for cold extruding workpiece 164 to reduce both the inside and outside diameters at its leading end 190 and along a predetermined portion of its length responsive to axial extrusion pressure applied by punch 184 to form a longitudinally extending shaft of reduced diametrical dimensions relative to the original diametrical dimensions of workpiece 164. As illustrated, end 190 of workpiece 164 bottoms against a kick-out pin 192 in die station 180 which assists in squaring the leading end 190 prior to its removal upon retraction of punch 184 and operation of the kick-out pin 192 to effect station transfer by transfer fingers, not shown, to a third die 194. At this station (FIG. 15), the trailing workpiece end 178 is likewise squared by punch 184.

Figure 16:
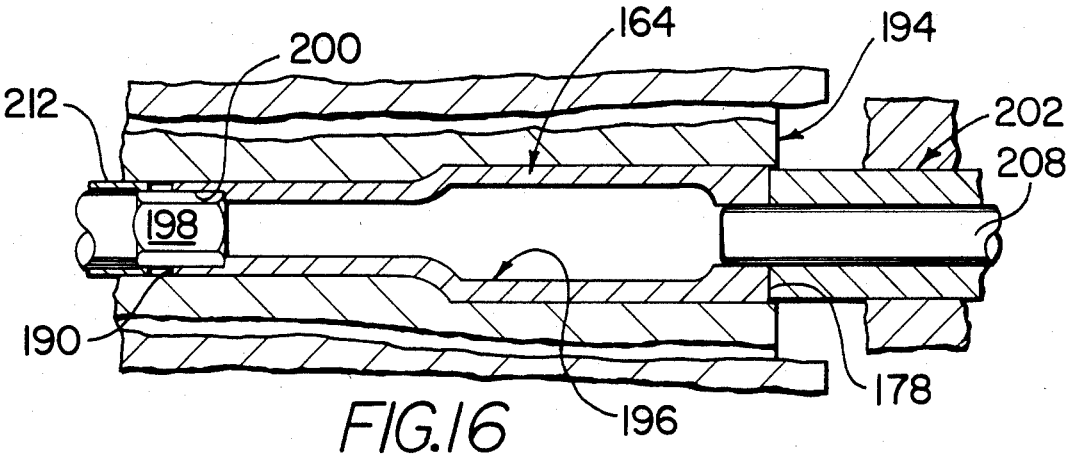
Figure 17:
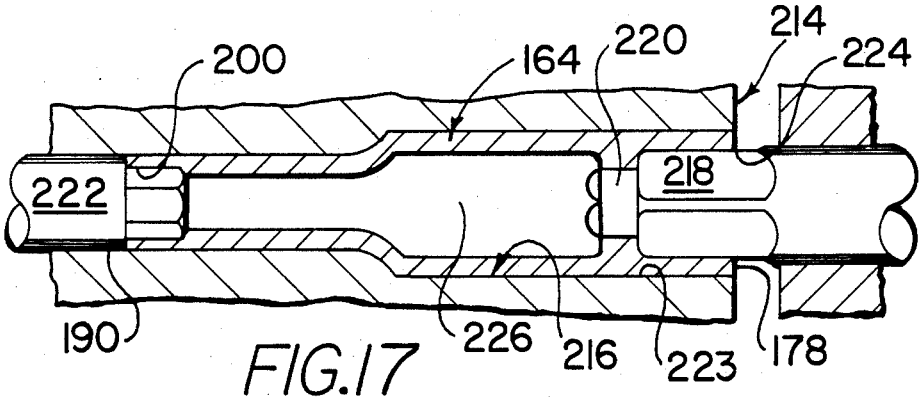

At the third die 194 depicted in FIG. 16, it will be understood that workpiece 164 is compressively driven into a conforming cavity 196 which has a fixed hex punch 198 centrally located within an interior end of die cavity 196 for forming a fastener driving hex socket 200 at the necked-down end 190 of the socket wrench workpiece 164.

Figure 18:
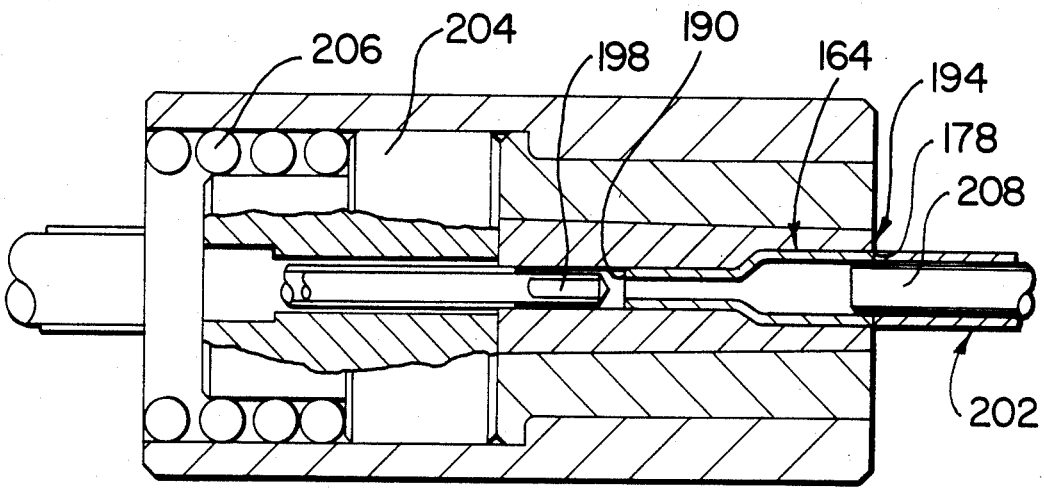
FIGS. 18 and 19 are views, partly in section and partly broken away, on a relatively reduced scale, showing additional detail in the apparatus utilized in the step depicted in FIG. 16.
Figure 19:
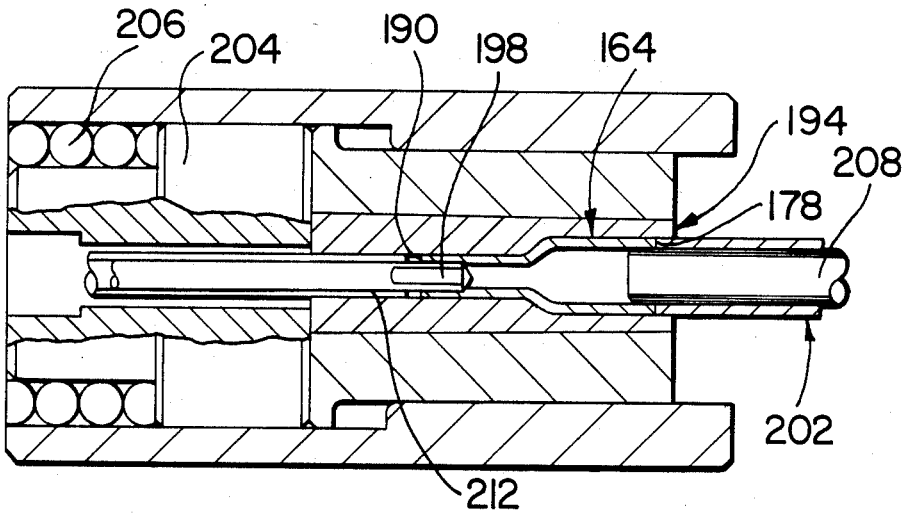

To prevent buckling of the extruded shaft during this step, die 194 is preferably a spring loaded sliding die whereby the socket wrench workpiece 164 is seated in die cavity 196 responsive to the driving action of punch 202 (FIGS. 16, 18 and 19). As punch 202 moves into its full throw position (FIGS. 16 and 19), sliding die 194 is driven against a spring loaded collar 204 to compress spring 206 as end 190 is driven against hex punch 198. To restrict trailing end 178 of workpiece 164 against any undesired material collapse during this operation, a sizing pin 208 is preferably provided (best shown in FIG. 16) to maintain the inside diameter at end 178 of the workpiece. Thereafter, as sizing pin 208 is retracted from workpiece 164, punch 202, acting as a stripper sleeve, remains temporarily fixed during ram backstroke to provide a timed knock-out upon operation of a movable kick-out sleeve 212 (FIG. 16) surrounding the fixed hex punch 198 to drive workpiece 164 out of die cavity 196 for transfer into a fourth die station 214 by transfer fingers, not shown.

Fourth die station 214 serves as a broaching die station such that when workpiece 164 (as formed in the preceding steps) is driven into die cavity 216 by a square punch 218 having a leading circular coaxially aligned pilot 220 of reduced diameter, a recess at trailing end 178 of workpiece 164 is accurately broached by pushing and shearing metal within end 178 by punch 218.

Accordingly, workpiece 164 is compressively driven as noted above into cavity 216 of die 214 to an extent limited by a hexagonal stop pin 222 under the driving force of broaching square punch 218. In this final die station 214, the broaching square punch 218 is provided with a minimum cross-sectional dimension across flats slightly larger than the diameter of the end opening of workpiece 164 and, upon that workpiece being forced into die cavity 216 by punch 218, a shearing action occurs as broaching punch 218 shears interior recess walls of end 178 a preselected distance along the length of that interior recess at end 178 of workpiece 164 to form an accurately sized square drive socket 224 of square cross section. Meantime, hexagonal stop pin 222 serves to dimensionally maintain the fastener driving hex socket 200 at end 190 of workpiece 164. Thereupon, the socket wrench 164 as now formed (FIG. 17) is knocked out of die cavity 216 by hexagonal stop pin 222, after punch 218 has been retracted, and is discharged from the machine.

By virtue of the disclosed invention, it has been found that there is a need for only minimum machining of a cosmetic nature to produce high quality parts which are relatively inexpensively finished upon completion of the above described uninterrupted processes. Although hot or warm forging may be utilized in this invention, it is not necessary, and the concomitant labor and processing costs accordingly may be eliminated. Furthermore, intermediate annealing, lubricant coatings and similar conventional process steps may be totally eliminated. The process of this invention begins with a workpiece having an outside diameter generally corresponding to the head size of the tool being formed. The invention may be performed on machines subjected to reduced stress loads due to the tubular nature of the starting workpiece, with corresponding reductions in maintenance and tooling replacement costs and requirements. Moreover, the normal costly and time consuming drilling operation is totally eliminated in the manufacture of nutdrivers and "deep" socket wrenches which are those over two inches long. It will be seen that high quality products may be precisely made in accordance with the disclosed methods in high production, low cost operations under demanding conditions.

As will be apparent to persons skilled in the art, various modifications, adaptations and variations of the foregoing specific disclosure can be made without departing from the teachings of this invention.

We claim:

1. A method of forming a socket wrench and other elongated hollow parts, such as a nutdriver, from a workpiece of metallic tubing having a generally uniform circular transverse cross section and a generally uniform wall thickness, the method comprising the steps of elongating the workpiece by driving the workpiece into a die cavity means with a power operated punch to cold extrude a leading axial portion of the workpiece, the elongating step being effected to increase the length of the workpiece by reducing both the inside and outside diameters at one end of the workpiece and along said leading axial portion extending a predetermined length from said one end and forming a longitudinally extending shaft of reduced diametrical dimensions relative to the original diametrical dimensions of the workpiece, maintaining the wall thickness along said longitudinally extending shaft generally equal to the original wall thickness of the workpiece during the elongating step, and broaching a recess of non-circular cross section at the other end of the workpiece opposite its said one end by driving a second power operated punch of non-circular cross section into said other end of the workpiece, maintaining the increased workpiece length and reduced dimension of the cross sectional diameter of said longitudinally extending shaft relative to said other end of the workpiece during the broaching step, and continuously retaining a circular transverse cross section throughout the length of the workpiece during the elongating and broaching steps.

2. The method of claim 1 wherein the broaching step is sequentially effected after the elongating step in a common die cavity means having an entrance section connected to a coaxially aligned elongated chamber section of cross-sectional diameter less than that of the entrance section.

3. The method of claim 1 including the further steps of providing first and second dies defining first and second internal cavities of said die cavity means, wherein the elongating step is effected sequentially in two separate stages in the first and second die cavities, a first stage of the elongating step including transferring the workpiece from the first die cavity after forming the reduced workpiece shaft, a second stage of the elongating step including inserting the workpiece into the second die cavity and forming the ends of the workpiece, and wherein the broaching step is effected by said second power operated punch in said second die cavity.

4. The method of claim 3 wherein the second stage of the elongating step includes squaring the ends of the workpiece in parallel planes perpendicular to a longitudinal axis of the workpiece.

5. The method of claim 3 wherein the second stage of the elongating step includes countersinking said other end of the workpiece.

6. The method of claim 1 further including the step of reducing the inside diameter of the workpiece at its said other end in a punch and die operation to compress the workpiece material at said other end preliminary to the broaching step.

7. The method of claim 6 wherein the step of reducing the internal diameter of the workpiece is performed before the elongating step and includes driving said one end of the workpiece into an elongated die cavity of uniform diameter between a sizing pin, received within the elongatd die cavity, and internal walls of the elongated die cavity located in spaced surrounding relation to said pin, thereby maintaining the outside diameter of the workpiece during the reducing step.

8. The method of claim 6 further including the step of forming a second recess of hexagonal cross section in said one end of the workpiece after the elongating step.

9. The method of claim 6 wherein the reducing step includes driving the workpiece into said die cavity means with a punch having a coaxially aligned pilot of reduced diameter relative to the original inside diameter of the workpiece for compressing the material at its said other end about the pilot.

10. The method of claim 6 wherein the elongating step comprises extruding a length of the workpiece extending from said one end thereof after the reducing step, wherein the broaching step includes forming a recess of square cross section in said other end of the workpiece, and wherein a further step is included of forming a second recess of hexagonal cross section in said one end of the workpiece.

11. A method of forming a socket wrench and other elongated hollow parts, such as a nutdriver, from a workpiece of metallic tubing having a generally uniform circular transverse cross section and a generally uniform wall thickness, the method comprising the steps of providing a plurality of dies defining first, second, third and fourth internal die cavities, a first stage of driving the workpiece into the first die cavity with a first power operated punch elongating the workpiece and reducing both the inside and outside diameters at one end of the workpiece and along a predetermined portion of its length therefrom to form a longitudinally extending shaft of reduced diametrical dimensions relative to the original diametrical dimensions of the workpiece, transferring the workpiece from the first die cavity and aligning the workpiece with the second die cavity, a second stage of driving the workpiece into the second die cavity with a second power operated punch to form the ends of the workpiece, transferring the workpiece from said second die cavity and aligning the workpiece with the third die cavity, forming a recess of non-circular cross section at the other end of the workpiece opposite its said one end by driving the workpiece into said third die cavity with a third power operated punch of non-circular cross section to form said recess of non-circular cross section in said other end of the workpiece, transferring the workpiece from said third die cavity and aligning the workpiece with the fourth die cavity, and then shaping the ends of the workpiece in a predetermined configuration by driving the workpiece into said fourth die cavity with a fourth power operated punch.

12. The method of claim 11 wherein the ends of the workpiece are squared in parallel planes perpendicular to its longitudinal axis during the second stage of the driving step and during the final shaping step.

13. The method of claim 11 wherein the workpiece is extruded during the first and second stages of the driving step to sequentially reduce both the inside and outside diameters at said one end of the workpiece and along a length thereof.

14. The method of claim 11 wherein the recess forming step is performed in the third die cavity by broaching said other end of the workpiece with the third power operated punch.

15. A method of forming a socket wrench and other elongated hollow parts, such as a nutdriver, from a workpiece of metallic tubing having a generally uniform circular transverse cross section and a generally uniform wall thickness, the method comprising the steps of elongating the workpiece by driving the workpiece into a die cavity means with a power operated punch to cold extrude a leading axial portion of the workpiece, the elongating step reducing both the inside and outside diameters at one end of the workpiece and along said leading axial portion extending a predetermined length from said one end and forming a longitudinally extending shaft of reduced diametrical dimensions relative to the original diametrical dimensions of the workpiece, maintaining the wall thickness along said longitudinally extending shaft generally equal to the original wall thickness of the workpiece during the elongating step, increasing the wall thickness at the other end of the workpiece opposite its said one end, and then broaching a recess of non-circular cross section at said other end of the workpiece by driving a second power operated punch of non-circular cross section into said other end of the workpiece, maintaining the reduced dimension of the cross sectional diameter of said longitudinally extending shaft relative to said other end of the workpiece during the broaching step, and continuously retaining a circular transverse cross section throughout the length of the workpiece during the elongating and broaching steps.

16. A method of forming elongated hollow parts, such as a nutdriver, from a workpiece of metallic tubing having a generally uniform circular transverse cross section and a generally uniform wall thickness, the method comprising the steps of elongating the workpiece by driving the workpiece into a die cavity means with a power operated punch to cold extrude a leading axial portion of the workpiece, the elongating step reducing both the inside and outside diameters at one end of the workpiece and along said leading axial portion extending a predetermined length from said one end and forming a longitudinally extending shaft of reduced diametrical dimensions relative to the original diametrical dimensions of the workpiece, maintaining the wall thickness along said longitudinally extending shaft generally equal to the original wall thickness of the workpiece during the elongating step, increasing the wall thickness at the other end of the workpiece opposite its said one end, broaching a recess of non-circular cross section at said other end of the workpiece by driving a second power operated punch of non-circular cross section into said other end of the workpiece, maintaining the reduced dimension of the cross sectional diameter of said longitudinally extending shaft relative to said other end of the workpiece during the broaching step, continuously retaining a circular transverse cross section throughout the length of the workpiece during the elongating and broaching steps, and deforming the reduced external shaft surface of the workpiece adjacent its said one end to form a generally longitudinally extending external groove along said shaft.

* * * * *